US008141923B2

(12) United States Patent
Bouligny et al.

(10) Patent No.: US 8,141,923 B2
(45) Date of Patent: Mar. 27, 2012

(54) SINGLE JOINT ELEVATOR HAVING DEPLOYABLE JAWS

(75) Inventors: Vernon Joseph Bouligny, New Iberia, LA (US); Scott Joseph Arceneaux, Lafayette, LA (US)

(73) Assignee: Frank's Casing Crew and Rental Tools, Inc., Lafayette, LA (US)

( * ) Notice: Subject to any disclaimer, the term of this patent is extended or adjusted under 35 U.S.C. 154(b) by 175 days.

(21) Appl. No.: 11/624,771

(22) Filed: Jan. 19, 2007

(65) Prior Publication Data

US 2008/0174131 A1 Jul. 24, 2008

(51) Int. Cl.
*E21B 19/10* (2006.01)

(52) U.S. Cl. ..... 294/102.2; 294/197

(58) Field of Classification Search ..... 294/102.1, 294/102.2, 103.1, 104, 113, 902, 88, 91, 294/197

See application file for complete search history.

(56) References Cited

U.S. PATENT DOCUMENTS

| | | | | |
|---|---|---|---|---|
| 1,211,999 | A | 1/1917 | Arey et al. | |
| 1,535,625 | A * | 4/1925 | O'Bannon | 294/91 |
| 1,548,337 | A | 8/1925 | Smith | |
| 1,558,261 | A * | 10/1925 | Grady | 294/91 |
| 1,656,582 | A | 1/1928 | Harder | |
| 1,690,709 | A * | 11/1928 | Wilson | 294/91 |
| 1,736,187 | A * | 11/1929 | Coleman | 294/91 |
| 1,754,288 | A | 4/1930 | Smith | |
| 1,766,920 | A | 6/1930 | Moody | |
| 1,814,990 | A * | 7/1931 | Weston | 294/91 |
| 2,009,942 | A | 7/1935 | Moody | |
| 2,105,077 | A | 1/1938 | Hertel | |
| 2,218,000 | A * | 10/1940 | Grau et al. | 294/91 |
| 3,915,244 | A | 10/1975 | Brown | |
| 4,035,012 | A | 7/1977 | Guier | |
| 4,269,554 | A | 5/1981 | Jackson | |
| 4,275,487 | A * | 6/1981 | Gray et al. | 188/67 |
| 4,361,940 | A * | 12/1982 | McFadden | 188/67 |
| 4,441,749 | A | 4/1984 | Blaschke et al. | |
| 4,576,254 | A | 3/1986 | Cox | |
| 4,579,379 | A * | 4/1986 | Berg | 294/102.2 |
| 4,604,724 | A | 8/1986 | Shaginian et al. | |

(Continued)

FOREIGN PATENT DOCUMENTS

GB 2346576 A 8/2000

(Continued)

OTHER PUBLICATIONS

Jun. 20, 2008 PCT Written Opinion of ISA for PCT/US08/050109.

(Continued)

*Primary Examiner* — Dean Kramer
(74) *Attorney, Agent, or Firm* — Osha • Liang LLP

(57) ABSTRACT

The present invention provides an apparatus and a method for lifting a single joint of pipe. The single joint elevator of the present invention comprises, in one embodiment, a pair of deployable jaws cooperating with a pair of static jaws to secure a pipe within the slot of a generally horseshoe-shaped body. The deployable jaws of the single joint elevator of the present invention may be rotatably deployable or translatably deployable, or both. In one embodiment, each jaw, including the static jaws and the deployable jaws, comprises a pipe slip movably disposed within the jaw to secure a pipe segment within the slot and to self-tighten as the weight of the pipe segment secured within the single joint elevator is transferred to the slips and the jaws.

39 Claims, 6 Drawing Sheets

U.S. PATENT DOCUMENTS

| | | | | |
|---|---|---|---|---|
| 4,647,099 | A | | 3/1987 | Berry et al. |
| 4,676,312 | A | | 6/1987 | Mosing et al. |
| 5,027,926 | A | * | 7/1991 | Cox ..... 188/67 |
| 5,127,790 | A | | 7/1992 | Teague |
| 5,299,848 | A | | 4/1994 | Boyer |
| 5,340,182 | A | | 8/1994 | Busink et al. |
| 5,791,410 | A | | 8/1998 | Castille et al. |
| 5,909,768 | A | | 6/1999 | Castille et al. |
| 6,227,587 | B1 | | 5/2001 | Terral |
| 6,568,479 | B2 | | 5/2003 | Mosing et al. |
| 6,742,596 | B2 | | 6/2004 | Haugen |
| 6,938,697 | B2 | | 9/2005 | Haugen |
| 6,976,540 | B2 | | 12/2005 | Berry |
| 6,997,265 | B2 | | 2/2006 | Berry |
| 7,032,678 | B2 | | 4/2006 | Mosing et al. |
| 2006/0185854 | A1 | | 8/2006 | Mosing et al. |
| 2008/0136203 | A1 | | 6/2008 | Krijnen et al. |
| 2009/0110535 | A1 | | 4/2009 | Pietras et al. |

FOREIGN PATENT DOCUMENTS

| | | | |
|---|---|---|---|
| WO | WO2005106185 | A | 11/2005 |

OTHER PUBLICATIONS

PCT "International Preliminary Report on Patentability", Jul. 31, 2009, pp. 1-8.

"SJH Horizontal Pickup Elevator" National Oilwell Varco, 2008, 1072 Rev. 03 brochure.

Weatherford, "Remote-Operated Single-Joint Elevator" Tubular Running Services, Document 7083.00, 2009, Houston, Texas, 2 pages.

BJ "Single Joint Elevators—Type SJ Auxiliary Elevator—Type SP Auxiliary Elevator" p. 53.

* cited by examiner

SINGLE JOINT ELEVATOR HAVING DEPLOYABLE JAWS

FIELD OF THE INVENTION

The present invention is directed to an apparatus and a method for securing a pipe segment or a stand of pipe to a cable, rope, line or other hoisting member to facilitate lifting of the pipe to an elevated position. The present invention is directed to an apparatus and a method for securely gripping and releasing a pipe segment or stand of pipe for use in drilling operations.

BACKGROUND OF THE RELATED ART

Wells are drilled into the earth's crust using a drilling rig. Pipe strings are lengthened by threadably coupling add-on pipe segments to the proximal end of the pipe string. The pipe string is generally suspended within the borehole using a rig floor-mounted spider as each new pipe segment or stand is coupled to the proximal end of the pipe string just above the spider. A single joint elevator is used to grip and secure the segment or stand to a hoist to lift the segment or stand into position for threadably coupling to the pipe string.

For installing a string of casing, exiting single joint elevators generally comprise a pair of hinged body halves that open to receive a joint of pipe and close to secure the pipe within the elevator. Elevators are specifically adapted for securing and lifting pipe having conventional connections. A conventional connection comprises an internally threaded sleeve that receives and secures one externally threaded end from each of two pipe segments to secure the segments in a generally abutting relationship. The internally threaded sleeve is first threaded onto the end of a first segment of pipe to form a "box end." The externally threaded "pin end" of the second segment of pipe is threaded into the box end to complete the connection between the segments. Typical single joint elevators have a circumferential shoulder that is forms a circle upon closure of the hinged body halves. The shoulder of the elevator engages the shoulder formed between the end of the sleeve and the pipe segment. Conventional single joint elevators cannot grip a pipe segment having intergral connections (having no circumferential shoulder), and conventional single joint elevators can only grip a pipe segment at the threaded sleeve that secures the connection.

Conventional elevators are difficult to use on pipe segments that are not conveniently accessible. For example, casing segments are often moved to the rig floor from a horizontal pipe rack and presented to the rig floor at a "V"-door. A conventional elevator requires enough clearance to close the hinged body halves around the casing segment. Depending on the length of the pipe and the proximity of the floor or other rig structures, there may be insufficient clearance around the casing segment for installing a conventional single joint elevator, often requiring repositioning of the casing segment so that the single joint elevator can be installed around the casing segment. Even if repositioning of each casing segment takes only a few seconds, delays for repeatedly repositioning casing segments in the V-door consumes a substantial amount of rig time.

What is needed is a single joint elevator that is securable to a pipe at multiple positions along the length of the pipe segment, and not only at the end connection. What is needed is a single joint elevator that is adapted for securing to the pipe segment notwithstanding close proximity of the rig floor or other rig structure. What is needed is a single joint elevator that can be used to lift single pipe segments without repositioning the pipe segment to secure the single joint elevator. What is needed is a versatile single joint elevator that facilitates lifting both a pipe segment having integral connections and a pipe segment having a conventional connection with a threaded sleeve received onto the end of the pipe segment.

SUMMARY OF THE PRESENT INVENTION

The present invention is directed to an apparatus for releasably securing a pipe segment or stand to a cable, rope, line or other hoisting member for lifting the pipe segment or stand into position for being threadably coupled to a pipe string suspended in a borehole. One embodiment of the invention comprises a generally horseshoe-shaped body having a slot for receiving a pipe, at least one static jaw, and at least one deployable jaw that deploys to trap the pipe within the slot of the body. The static jaw may be secured to the body in a position to contact and bear against a pipe that has been sufficiently received into the slot. The at least one deployable jaw has a removed position permitting entry of the pipe into the slot, and a deployed position to secure the pipe within the slot. The body is adapted for supporting the at least one static jaw and the at least one deployable jaw, and also for being lifted and for transferring the weight of the pipe to a cable, rope, line or other hoisting member.

The deployable jaw of the present invention comprises a jaw movable between a removed position and a deployed position. The deployable jaw is either rotatably deployed or translatably deployed, or a combination of both, from its removed position to its deployed position. The deployable jaw may be pneumatically, hydraulically, manually and/or electrically actuated from its removed position to its deployed position. The deployable jaw of the present invention may be deployed using a pneumatic, hydraulic or electric motor for deploying the jaw to trap the pipe within the slot of the body.

Each static jaw and each deployable jaw may comprise a pipe slip that is movable between an engaged position and a disengaged position. Movement of the slip toward the engaged position moves the slip radially inwardly toward the pipe within the slot to decrease the clearance between the pipe slip in the at least one static jaw and the generally opposed pipe slip in the at least one deployable jaw, and movement of the slip toward its disengaged position moves the slip radially outwardly away from the pipe within the slot to increase the clearance between the pipe slip in the at least one static jaw and the generally opposed pipe slip in the at least one deployable jaw. Each static jaw and each deployable jaw may comprise one or more grooves for slidably receiving tabs, keys, or guides for imposing a predetermined path for movement of the pipe slip within the jaw. For example, a pipe slip may have a pair of tabs, one protruding from each side of the slip, and each tab may be slidably received into a groove in the jaw for imposing upon the pipe slip a predetermined path of movement extending in the engaged direction for closing the pipe slips on the pipe received within the slot, and in the disengaged direction for retracting the pipe slips away from the pipe received within the slot. Each slip may comprise a pipe contact surface, such as a removable insert, that may comprise a textured surface adapted for gripping contact with the external wall of the pipe received into the slot.

The deployable jaw may be mechanically locked into its deployed position within the slot for gripping and supporting a pipe. An over-center mechanical linkage and a worm gear are two examples of mechanisms that may be used for mechanically locking the deployed jaw into its deployed position. The deployable jaw may also be equipped with one or more deployment sensors for sensing proper deployment and position, and for automatically enabling use of the apparatus only when the deployable jaws are deployed and/or locked in their pipe gripping positions within the slot. For example, a deployment sensor(s) may operate to prevent deployment of a second deployable jaw until the first deployable jaw is fully deployed and/or locked into position.

The foregoing and other objects, features and advantages of the invention will be apparent from the following more particular description of a preferred embodiment of the invention, as illustrated in the accompanying drawings wherein like reference numbers represent like parts of the invention.

DETAILED DESCRIPTION OF THE PRESENT INVENTION

Figure 1:
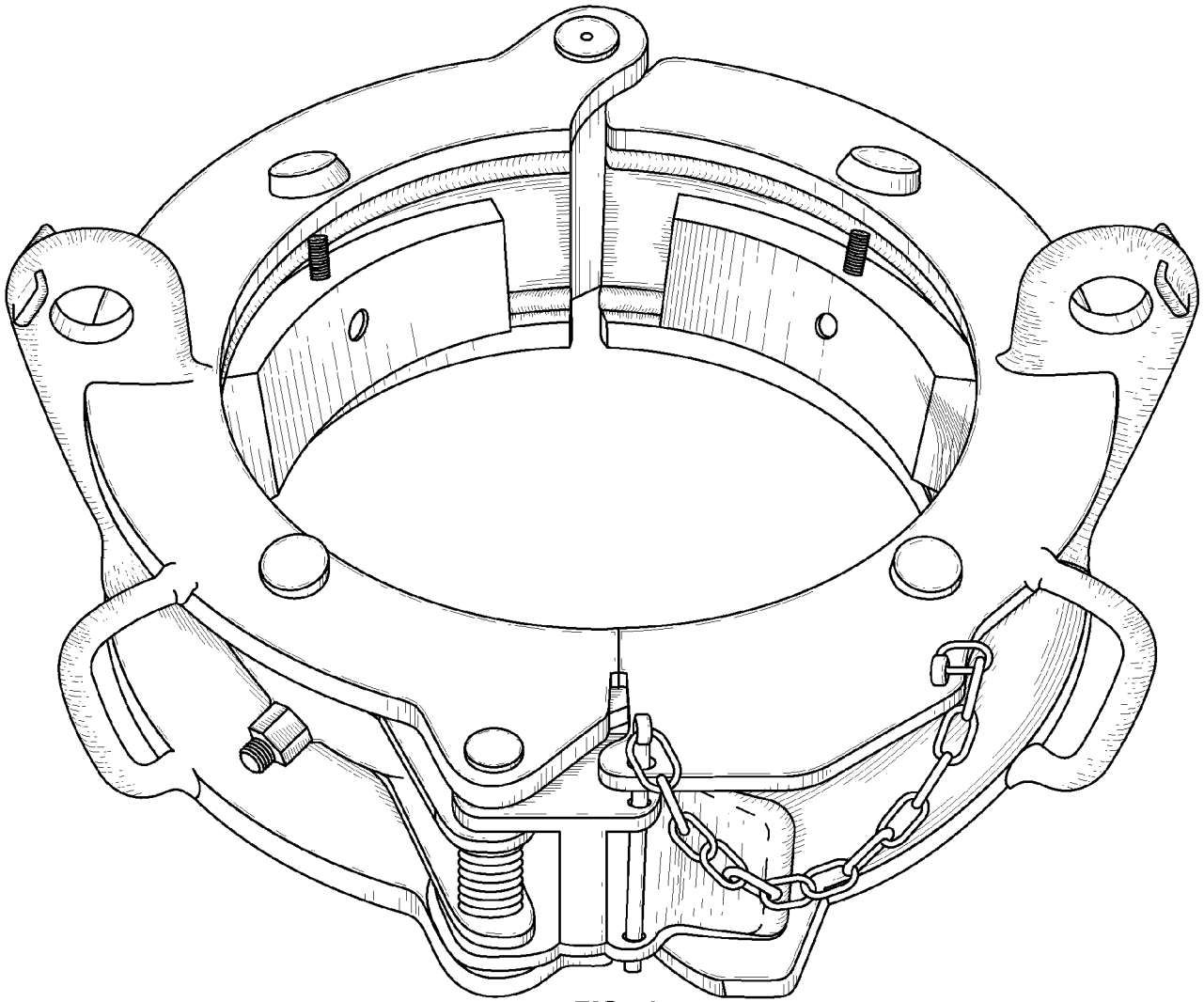
FIG. 1 (Prior Art)
FIG. 1 is a perspective view of a prior art single joint elevator having a pair of opposing hinged body halves for opening, receiving a pipe, and then closing around a pipe received within the opened body halves.

FIG. 1 is a perspective view of a prior art single joint elevator having a pair of opposing and hinged body halves for opening, receiving a pipe segment, and closing around a pipe segment (not shown) that is received within the opened body halves. These elevators are unsuitable for gripping pipe having integral connections, and they are unsuitable for gripping pipe with conventional connections at locations along the length of the pipe segment removed from the end of the segment. These elevators are often difficult to position on the pipe segment due to interference with the rig floor or other rig structures, as well as difficult to open and close, especially if the locking pin is in a bind.

Figure 2:
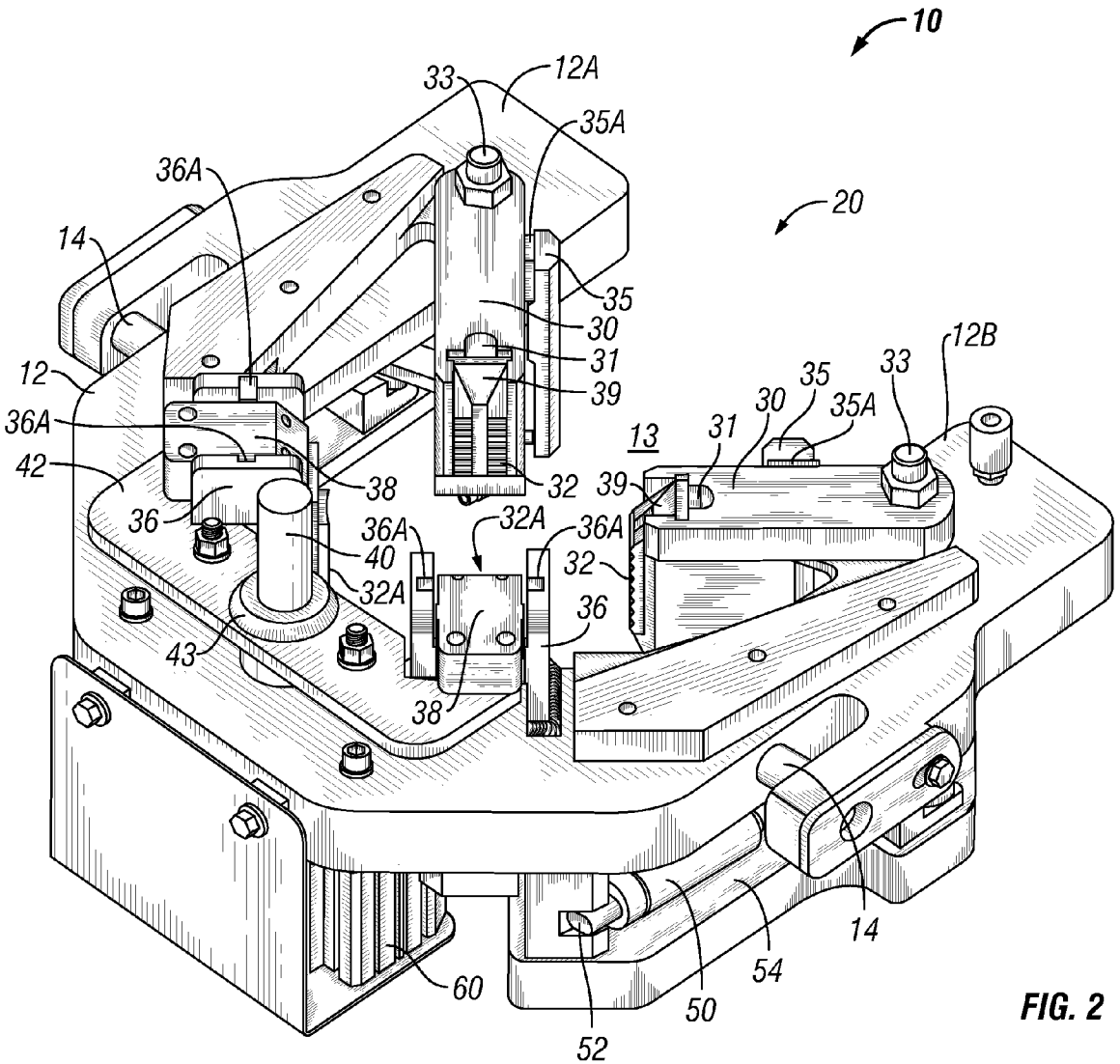
FIG. 2 is a perspective view of one embodiment of the single joint elevator of the present invention showing a pair of rotatably deployable jaws in their deployed positions to secure a pipe segment (not shown) within the slot in the body of the elevator.

FIG. 2 is a perspective view of one embodiment of the single joint elevator 10 of the present invention showing a pair of generally opposed rotatably deployable jaws 30, both shown in their deployed positions to secure a pipe segment (not shown) within the slot 13 in the generally horseshoe-shaped body 12. Each deployable jaw 30 is supported by the body 12 and rotatably deployable about a pivot 33, and the range of rotation of the deployable jaw 30 is determined by the position of a stop 35 and also by the dimensions of the linkages that operate to deploy and retract the jaw 30. A deployment sensor 35A may be disposed on the stop 35. Each deployable jaw 30 comprises a pipe slip 39 movably received within a slip well 31 in the deployable jaw 30, each pipe slip 39 being movable between an engaged position and a retracted position, as will be discussed in more detail below.

The body 12 in FIG. 2 also supports a pair of static jaws 36, each having a pipe slip 38 movably received within the static jaw 36. In the embodiment shown in FIG. 2, each pipe slip 38 has a pair of opposed keys (not shown) extending generally parallel with the contact surface 32A of the pipe slip 38 and outwardly from each opposed side of the pipe slip 38. The keys (not shown) are received into generally opposed grooves 36A in the jaw for imparting a predetermined pathway to the pipe slip 38 as it moves between its lowered and engaged position and its raised and disengaged position. The pipe slips 38 are coupled to and positionable by powered movement of the leveling member 42. The leveling member 42 slides vertically on collar post 40 and supports and moves the pipe slips 38 upwardly to disengage the pipe segment (not shown) and downwardly to engage the pipe segment. The leveling member 42 is positionable by operation of a static jaw cylinder 60 to position the leveling member 42 and the pipe slips 38 within the static jaws 36 to cooperate with the pipe slips 39 of the deployable jaws 30 when in their deployed position, as shown in FIG. 2.

The body 12 of the single joint elevator 10 may be securable to one or more cables, ropes, lines or other hoisting members (not shown) at a pair of generally opposed lugs 14 to facilitate lifting and positioning of the single joint elevator 10 and the pipe segment (not shown) secured therein. The lugs 14 may be removable and replaceable to facilitate securing the single joint elevator 10 to a loop formed in the end of a cable (not shown).

Figure 3:
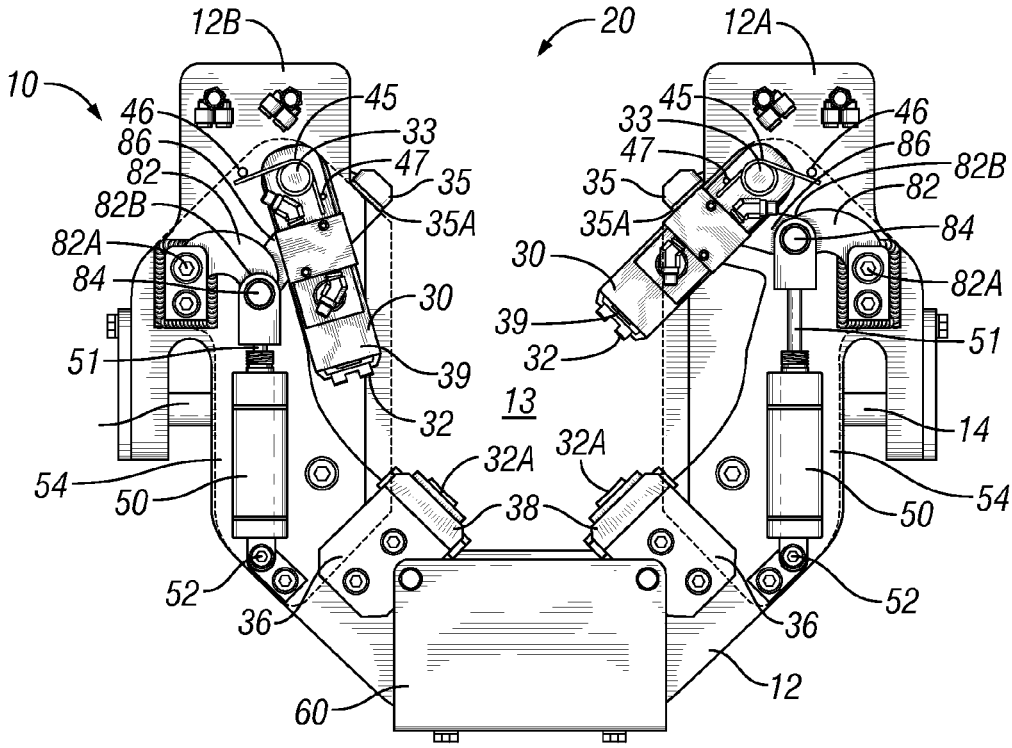
FIG. 3 is a bottom view of the embodiment of FIG. 2 showing one of the pair of deployable jaws deployed by operation of a cylinder to its deployed position within the slot.

The deployable jaws 30 are rotatably deployable from their removed positions (see left-side deployable jaw 30 in FIG. 3) to their deployed positions (see FIG. 2) using a deployment cylinder 50. As shown in FIG. 3, each deployment cylinder 50 is pivotally secured to body 12 at pivot 52. The pivot 52 allows the cylinder 50 to rotate about pivot 52 during deployment of the deployable jaw 30 from its removed position to its deployed position. The cylinder rod 51 extends from the cylinder 50 during actuation by the introduction of a pressurized fluid acting against a piston (not shown) within the cylinder to operate the mechanical deployment linkage comprising the rod end clevis 84, stabilizer 82 and deployment arm 86. Rod end clevis 84 pivotally couples the moving end 82B of rotating stabilizer 82 to the cylinder rod 51 and also to the deployment arm 86. The cylinder rod 51 extends upon actuation of the cylinder to rotate stabilizer 82 and simultaneously rotate and deploy deployable jaw 30 about pivot 33 and into the slot 13 to its deployed position (shown in FIG. 2 and one the right side of FIG. 3.) The deployable jaw 30 may rotate until it contacts and bears against stop 35. The cylinder rod 51 may be spring biased to its extended position corresponding to the deployed position of the deployable jaw 30.

In one embodiment of the present invention, the deployment linkage comprising rod end clevis 84, stabilizer 82 and deployment arm 86 is configured to be an over-center linkage; that is, the dimensions and shapes of these components cooperate with the deployment stroke of the cylinder rod 51 to secure the deployable jaw 30 in its deployed position by briefly reversing the angular direction of rotation of the deployment jaw 30 about its pivot 33 just before the rod 51 achieves its maximum deployment extension from cylinder 50. This configuration of the deployment linkage causes the deployment jaw 30 to briefly reverse and rotate through a relatively insubstantial angle back toward its removed position (shown on the left side of FIG. 3) before the actuation of the cylinder 50 terminates. Maintaining fluid pressure on the cylinder 50 to bear against cylinder rod 51 and the rod end clevis 84 rotatably locks the deployment jaw 30 into position for engaging and supporting the pipe (not shown) received within the slot 13. Upon initial retraction of the cylinder rod 51 from its fully deployed position back towards its retracted position within the cylinder 50, the deployment jaw 30 briefly rotates about pivot 33 and further into the slot 13 before it reverses and rotates back to its removed position within or adjacent to the body 12.

The body 12 may be adapted with apertures, recesses, channels, lugs, and related features for accommodating the various components that cooperate to facilitate the single joint elevator function. Lugs 14 accommodate coupling to rigid lift links or to a cable, chain, rope or lift line for lifting of the single joint elevator using a hoist. Cylinder recesses 54 (see FIG. 2) within each prong 12A, 12B of body 12 receive the pivotably secured cylinders 50 that operate to deploy the deployable jaws 30. Static jaw cylinder 60 engages and reciprocates leveling member 42 (see FIG. 2) to position the slips 38 of static jaws 36. Deployable jaw pivot 33 may be a bolt received through two or more aligned apertures in the deployment jaws 30 and in prongs 12A, 12B of the body 12. These and other components may be removable or adjustable to provide for removal, repair or replacement of components of the single joint elevator, or modular replacement of components to adapt the single joint elevator to accommodate a range of sizes of pipe within the slot 13.

FIG. 3 is a bottom view of the embodiment of the single joint elevator of FIG. 2 showing one (the right) of the pair of deployable jaws 30 rotated, by operation of the right cylinder 50, to its deployed position within the slot 13. The left cylinder 50 remains inactive and the left deployment jaw 30 remains in its removed position within the cylinder recess 54 of the body 12. Both deployment jaws 30 may be adapted for simultaneous deployment into the slot 13. For illustration purposes, FIG. 3 shows both the deployed and retracted positions of the deployable jaws 30 of the single joint elevator 10 of the present.

Figure 4:
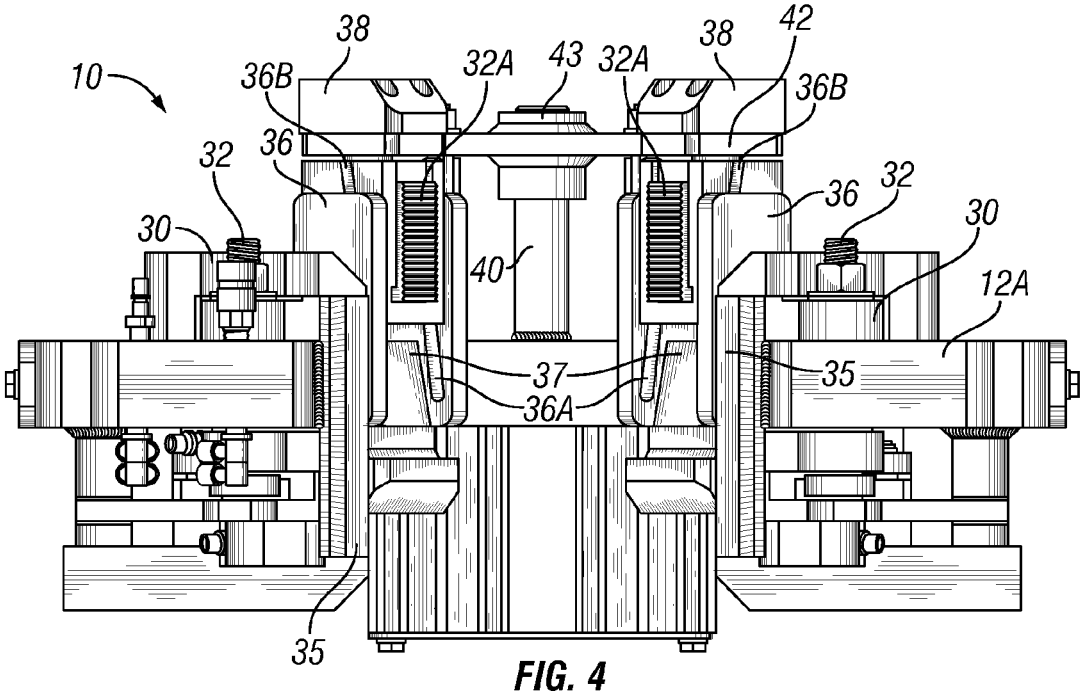
FIG. 4 is a front elevation view of the embodiment of FIG. 2 showing the pipe slips of the static jaws elevated and retracted to their disengaged positions and the deployable jaws retracted to their disengaged positions.

FIG. 4 is a front elevation view of the embodiment of FIG. 2 showing the pipe slips 38 elevated within static jaws 36 by leveling member 42 raised vertically on collar post 40 to retract the pipe slips 38 to their disengaged positions, and also showing the deployable jaws 30 retracted to their disengaged positions. The leveling member 42 engages and slidably elevates the pipe slips 38 along the predetermined path imposed by keys 36B slidably received within opposed grooves 36A within the static jaw 36. The pipe slips 38 slide between the engaged and retracted positions and, in the engaged position, bear against load bearing surface 37. The leveling member 42 may be spring or gravity-biased to its engaged position, spring-biased to retract upwardly to its disengaged position, or it may be powered in one or both of the upwardly (retracted) and downwardly (engaged) directions using the same source of fluid pressure used to operate deployment cylinders (see element 50 in FIG. 3).

Figure 5:
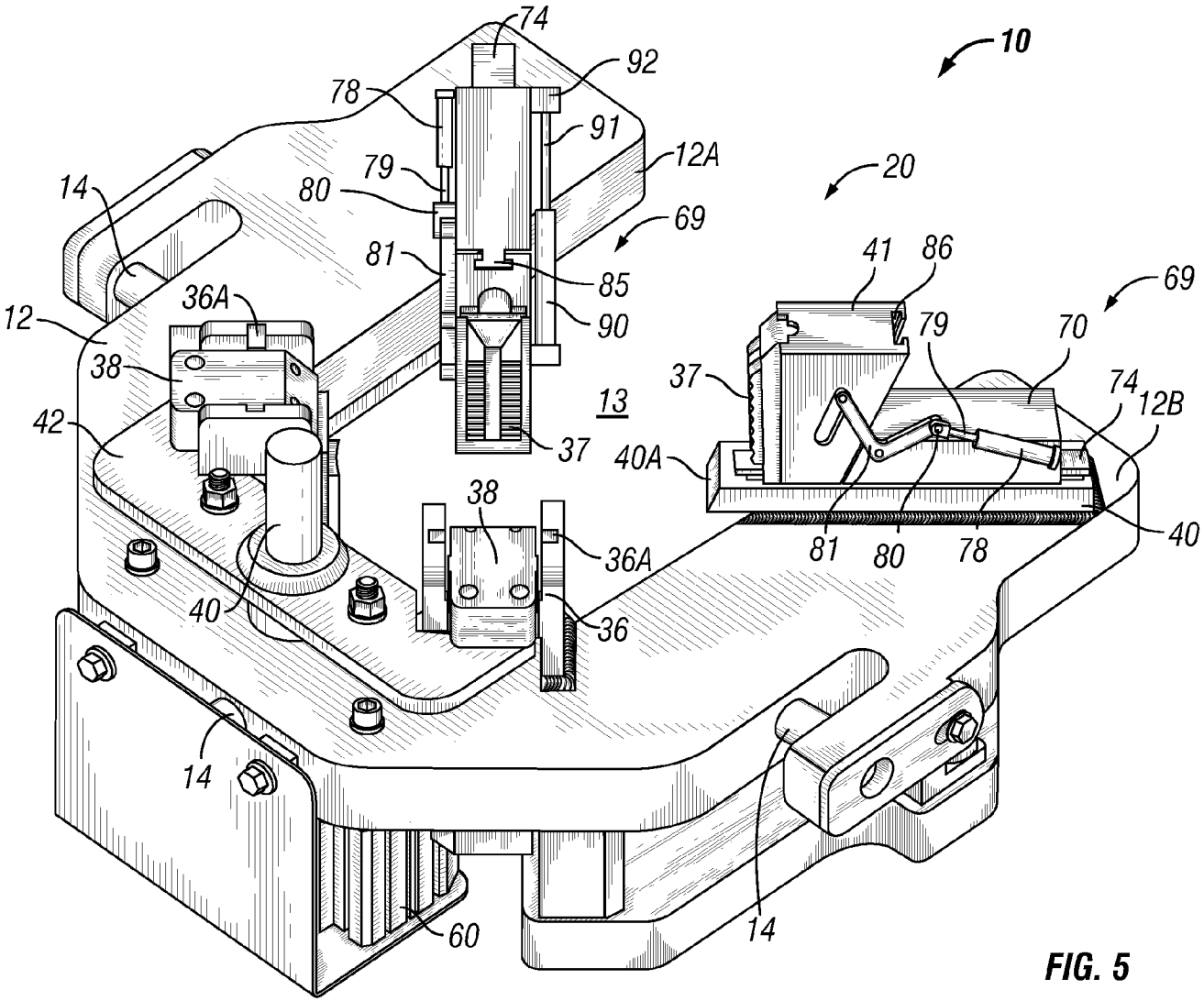
FIG. 5 is a perspective view of an alternate embodiment of the present invention having a pair of translatably deployable jaws with one jaw translated to its deployed position within the slot of the body and the opposing deployable jaw remaining in its retracted position

FIG. 5 is a perspective view of an alternate embodiment of the present invention having a pair of translatably deployable jaws 69 with the left deployable jaw translated and deployed into the slot 13 to its deployed position to engage a pipe segment (not shown), and the right deployable jaw remaining in its retracted position. The translatably deployable jaws 69 shown in FIG. 5 are secured to the top surface of prongs 12A, 12B of the body 12, but may alternately be disposed within and deployable from recesses within the body 12 or below the body 12 as are the deployment cylinders 50 shown in FIGS. 2 and 3.

Figure 5A:
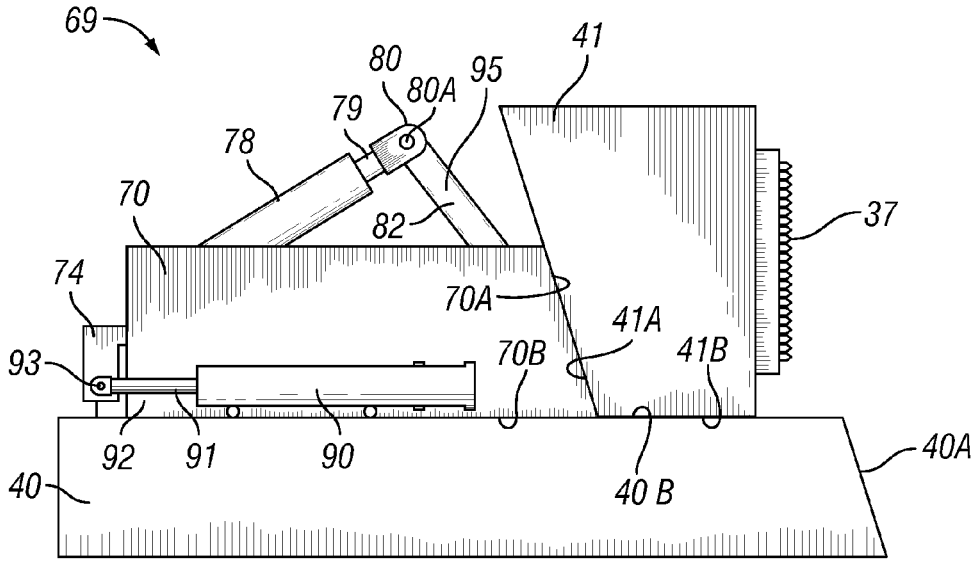
FIG. 5A is a side elevation view of the retracted translatably deployable jaw shown in the embodiment of FIG. 5.

FIG. 5A is a side elevation view of the retracted translatably deployable jaw 69 shown in the embodiment of FIG. 5 secured to the right prong 12B of the body 12. The translatably deployable jaw 69 comprises a T-rail 74 secured to a base 40 that is, in turn, secured to the right prong (see element 12B of FIG. 5) of the body 12. The T-rail 74 is slidably received into a mating T-shaped groove (not shown) within sliding block 70 to facilitate sliding translation of the sliding block 70 relative to the body 12. Translation is controllably imparted to the sliding block 70 using one or more translation cylinders 90 (see FIGS. 5A and 5B) that extend and retract a translation rod 91 having a piston end (not shown) within translating cylinder 90 and coupled to the base 40 at or near the end of the T-rail 74. The translation cylinder 90 may be a double-acting cylinder, or it may be spring-biased to either its extended position (shown in FIG. 5B) or to its retracted position (shown in FIG. 5A).

The translatably deployable jaw 69 further comprises a descending block 41 for cooperating with the sliding block 70. The descending block 41 may comprise a pipe contact cooperating with the sliding block 70. The descending block 41 may comprise a pipe contact surface 37 for contacting a pipe (not shown) to be secured within the slot of the single joint elevator. The descending block 41 comprises a first sliding surface 41A for sliding along the sliding surface 70A of the sliding block 70, and a second sliding surface 41B for sliding along the supporting surface 40B of the base 40. The second sliding surface 41B on the descending block 41 is adapted for sliding along the supporting surface 40B of base 40 when the sliding surface 41B of the descending block 41 is aligned with the sliding surface 70B of the sliding block 70 as shown in FIG. 5A. Descending block 41 is selectively moveable relative to the sliding block 70 only when the sliding surface 70A of the sliding block 70 is aligned with the sliding surface 40A of the base 40. Descending block cylinder 78 is pivotally secured at pivot end 78A to the sliding block 70, and extends and retracts cylinder rod 79 coupled to an elbow coupling 80 for pivotally coupling the rod 70 to the first leg 82 of boomerang link 95. The boomerang link 95 is pivotally coupled to the sliding block 70 at pivot 81A. The second leg 81 of the boomerang link 95 extends at an angle to the first leg 82 and is pivotally coupled to retainer pin 81B that extends generally perpendicular from the second leg 81 into rod slot 94 in the descending block 41. The retainer rod 81B extends into and is movable within rod slot 94 of the descending block 41 to facilitate downwardly and inwardly movement of the descending block along the inclined sliding surface 70A of the sliding block 70 and aligned sliding surface 40A of the base 4B.

Figure 5B:
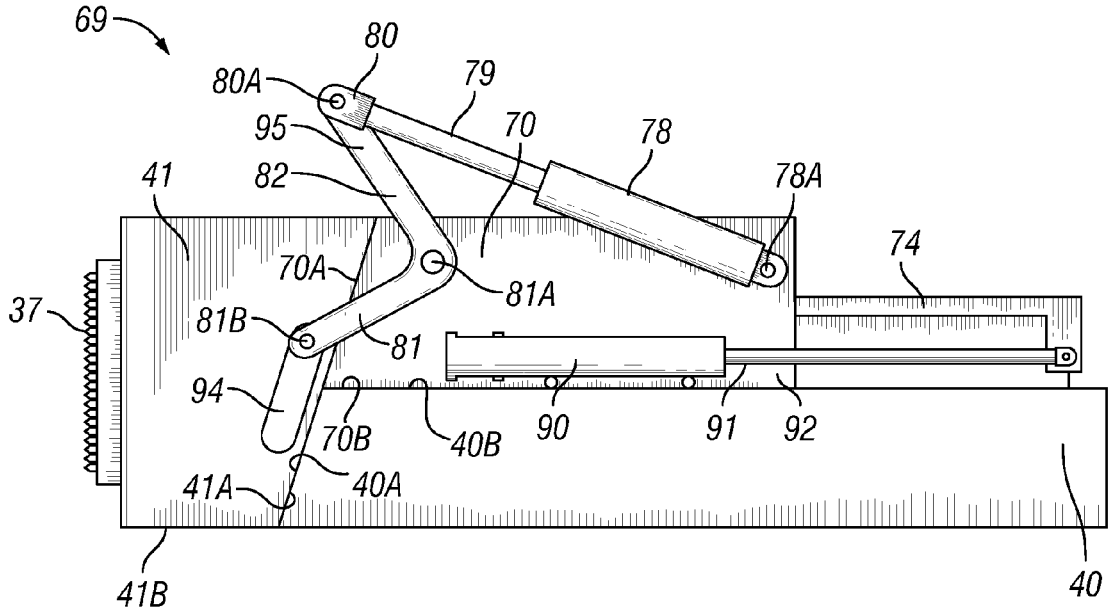
FIG. 5B is a side elevation view of the deployed translatably deployable jaw shown in the embodiment of FIG. 5.

The operation of the components of the translating jaw 69 shown in FIGS. 5, 5A and 5B is easily determined from examination of FIGS. 5A and 5B. Prior to deployment, the translating jaw 69 appears as it does in FIG. 5A. As deployment begins, the translation cylinder 90 is actuated to extend rod 91 and to translate both sliding block 70 and descending block 41 horizontally along the base 40. During this translation, aligned sliding surfaces 70B and 41B slide along support surface 40B of the base 40. The inwardly (into the slot—see element 13 on FIG. 5) and downwardly movement of descending block 41 toward engagement with the pipe (not shown) begins when the translation of sliding block 70 and descending block 41 aligns sliding surface 41A of the descending block 41 with sliding surface 40A of the base 40. After alignment, the descending block 41 descends along the sliding surface 40A as permitted by the length (in a direction parallel to the sliding interface between sliding surfaces 41A and 40A) of rod slot 94 until it achieves a position shown in FIG. 5B and the radial inwardly movement of the descending block 41 causes the pipe contact surface 37 to engage and grip the pipe segment (not shown) received into the slot (see element 13 of FIG. 5).

FIGS. 5, 5A and 5B show one embodiment of the present invention having translatably deployable jaws, each translatably deployable jaw having two or more cylinders for deploying the jaw to engage the pipe. The translatably deployable jaw may be adapted for operation using only one cylinder by, for example, eliminating translation cylinder 90 and by pivotally coupling descending block cylinder 78 to the T-rail at pivot 93 instead of pivotally coupling descending block cylinder 78 to the sliding block 70 at pivot 78A. Other cylinder arrangements may provide satisfactory deployment of the translatably deployable jaw in accordance with the scope of this invention.

Figure 6:
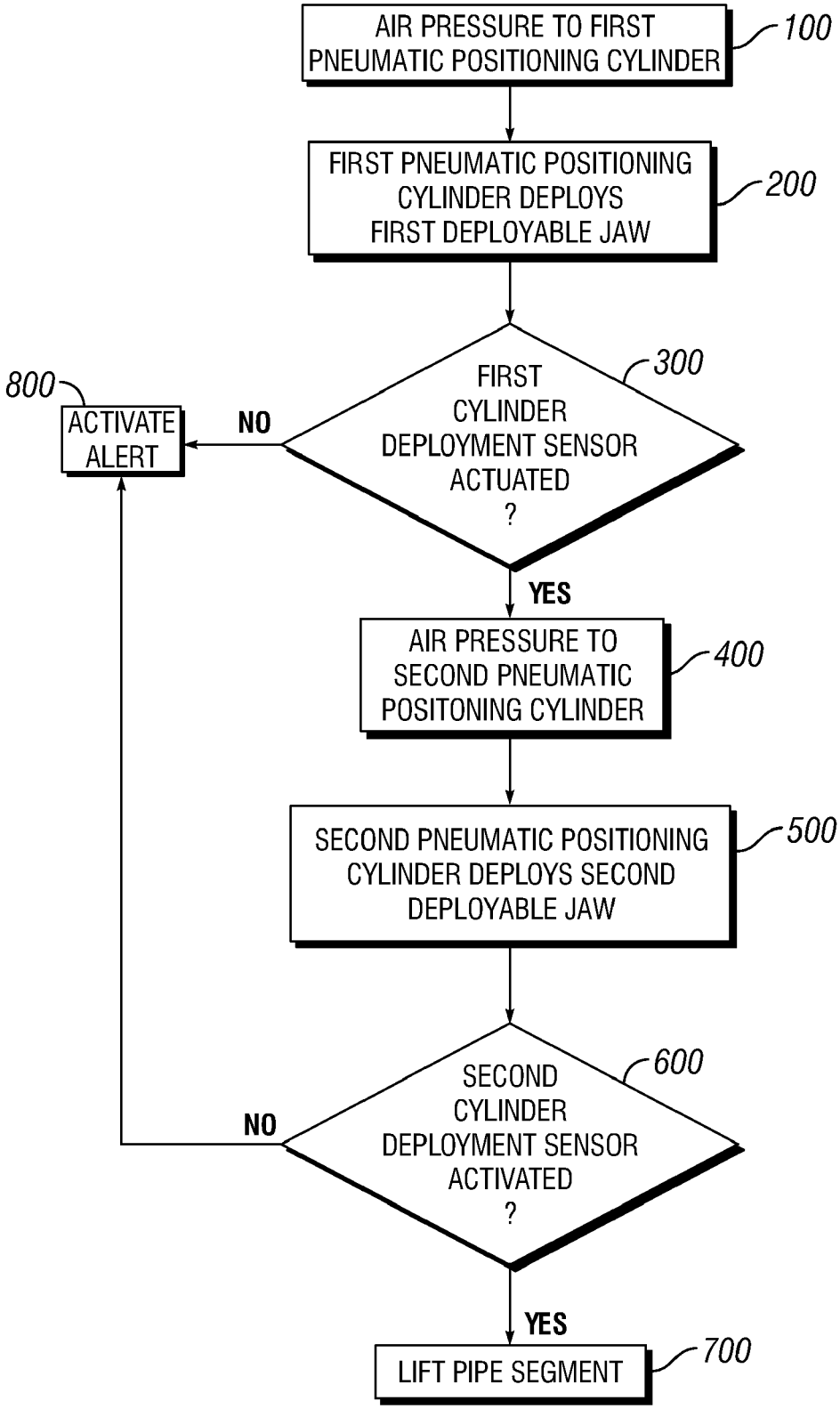
FIG. 6 is a logic flow diagram showing the steps of one embodiment of the method of securing and lifting a pipe of the present invention.

FIG. 6 is a logic flow diagram showing the steps of one embodiment of a method for securing a pipe segment to a lift line. The method comprises supplying air pressure to the first pneumatic positioning cylinder 100, deploying first pneumatic positioning cylinder and first deployable jaw 200, sensing deployment of the first pneumatic positioning cylinder 300, supplying air pressure to the second pneumatic positioning cylinder 400, deploying second pneumatic positioning cylinder and second deployable jaw 500, sensing deployment of the second pneumatic cylinder 600, and lifting the pipe segment by activation of a winch and cable coupled to the single joint elevator 700. If the first or second deployment cylinders fail to function, an alert is activated 800.

The terms "comprising," "including," and "having," as used in the claims and specification herein, indicate an open group that includes other elements or features not specified. The term "consisting essentially of," as used in the claims and specification herein, indicates a partially open group that includes other elements not specified, so long as those other elements or features do not materially alter the basic and novel characteristics of the claimed invention. The terms "a," "an" and the singular forms of words include the plural form of the same words, and the terms mean that one or more of something is provided. There terms "at least one" and "one or more" are used interchangeably.

The term "one" or "single" shall be used to indicate that one and only one of something is intended. Similarly, other specific integer values, such as "two," are used when a specific number of things is intended. The terms "preferably," "preferred," "prefer," "optionally," "may," and similar terms are used to indicate that an item, condition or step being referred to is an optional (not required) feature of the invention.

It should be understood from the foregoing description that various modifications and changes may be made in the preferred embodiments of the present invention without departing from its true spirit. The foregoing description is provided for the purpose of illustration only and should not be construed in a limiting sense. Only the language of the following claims should limit the scope of this invention.

We claim:

1. An elevator to grip a rigid shoulderless pipe segment having a substantially circular cross-section to be hoisted, the elevator comprising:

a body having a slot therein to laterally receive the rigid shoulderless pipe segment;

at least one deployable jaw coupled to the body and movable between a removed position generally disposed within the body, permitting the rigid shoulderless pipe segment to enter the slot, and a deployed position, the at least one deployable jaw having a slip; and at least one actuator operatively coupled between the body and the at least one deployable jaw such that the at least one actuator moves the at least one deployable jaw between the removed position and the deployed position;

wherein the at least one deployable jaw is lockable in the deployed position to prevent lateral removal of the rigid shoulderless pipe segment from the slot.

2. The elevator of claim 1 further comprising:

an over-center linkage coupled between the at least one actuator and the at least one deployable jaw.

3. The elevator of claim 1 further comprising:

at least one recess within a prong of the body to receive at least a portion of the at least one deployable jaw in the removed position;

wherein the at least one recess of the prong of the body is generally intermediate an open end of the slot at which the rigid shoulderless pipe segment is laterally received and an opposite end of the slot.

4. The elevator of claim 1 further comprising:

at least one static jaw coupled to the body adjacent the slot; and a jaw pivot to pivotably couple the at least one deployable jaw to the body;

wherein the slip of the at least one deployable jaw in the deployed position grips the shoulderless pipe.

5. The elevator of claim 1 wherein the at least one deployable jaw comprises a first deployable jaw and a second deployable jaw.

6. The elevator of claim 5 further comprising:

a first recess of a first prong of the body to receive at least a portion of the first deployable jaw in the removed position; and a second recess of a second prong of the body to receive at least a portion of the second deployable jaw in the removed position.

7. The elevator of claim 5 further comprising:

a first jaw pivot to pivotably couple the first deployable jaw to the body;

a second jaw pivot to pivotably couple the second deployable jaw to the body;

wherein the slip of the first deployable jaw in the removed position and the slip of the second deployable jaw in the removed position are together disposed generally between an open end of the slot at which the rigid shoulderless pipe segment is laterally received into the body and an opposite end of the slot.

8. The elevator of claim 5 further comprising:

a first linkage coupled between the body and the first deployable jaw to lock the first deployable jaw in the deployed position; and a second linkage coupled between the body and the second deployable jaw to lock the second deployable jaw in the deployed position.

9. The elevator of claim 8 wherein the at least one actuator comprises a first cylinder and a second cylinder;

wherein the first cylinder is extendable to lock the first deployable jaw in the deployed position; and wherein the second cylinder is extendable to lock the second deployable jaw in the deployed position.

10. The elevator of claim 1 wherein the at least one actuator is pivotably coupled to the body.

11. The elevator of claim 1 wherein the slip is coupled to the at least one deployable jaw such that the slip is movable thereon between a disengaged position and an engaged position.

12. The elevator of claim 11 wherein the slip is biased to the disengaged position.

13. The elevator of claim 11 further comprising:

at least one static jaw coupled to the body adjacent the slot;

at least one slip coupled to the at least one static jaw and movable thereon between a disengaged position and an engaged position.

14. The elevator of claim 13 further comprising:

at least another actuator extendable to move the at least one slip on the at least one static jaw.

15. The elevator of claim 1 further comprising:

a pivot about which the at least one deployable jaw is movable between the removed position and the deployed position.

16. An elevator to grip a rigid shoulderless pipe segment having a substantially circular cross-section to be hoisted, the elevator comprising:

a body having a slot with an entry end to laterally receive the rigid shoulderless pipe segment into the slot;

at least one deployable jaw coupled to the body and movable between a removed position generally disposed along the slot and within the body and a deployed position to prevent lateral removal of the rigid shoulderless pipe segment from the slot, the at least one deployable jaw having a slip; and at least one actuator operatively coupled between the body and the at least one deployable jaw such that the at least one actuator moves the at least one deployable jaw between the removed position and the deployed position.

17. The elevator of claim 16 wherein the at least one deployable jaw comprises a first deployable jaw and a second deployable jaw.

18. The elevator of claim 17 wherein the first deployable jaw and the second deployable jaw are positionable to together provide a convergence to guide the rigid shoulderless pipe segment into the slot.

19. The elevator of claim 18 further comprising:

at least one deployment linkage to move at least one of the first deployable jaw and the second deployable jaw from the removed position to the deployed position and to lock the at least one of the first deployable jaw and the second deployable jaw in the deployed position.

20. The elevator of claim 17 further comprising:

a first jaw pivot to couple the first deployable jaw to the body; and a second jaw pivot to couple the second deployable jaw to the body;

wherein at least a portion of the first deployable jaw and at least a portion of the second deployable jaw, in the removed position and the deployed position and in all positions between the removed and deployed positions, together remain generally within the body.

21. The elevator of claim 16 wherein the slip is coupled to the at least one deployable jaw such that the slip is movable between a disengaged position and an engaged position.

22. The elevator of claim 21 further comprising:

a biasing member to bias the slip to the disengaged position.

23. An elevator to grip a rigid shoulderless pipe segment having a substantially circular cross-section to be hoisted, the elevator comprising:

a body having a slot to laterally receive the rigid shoulderless pipe segment to a gripping position within the body;

at least one deployable jaw coupled to the body and movable between a removed position generally along the slot and within the body to permit the rigid shoulderless pipe segment to be laterally received into the slot and a deployed position to prevent lateral removal of the rigid shoulderless pipe segment from the slot, the at least one deployable jaw having a slip; and at least one actuator to move the at least one deployable jaw between the removed position and the deployed position.

24. The elevator of claim 23 wherein the slip is coupled to the at least one deployable jaw such that the slip is movable between a disengaged position and an engaged position.

25. The elevator of claim 24 further comprising:

a biasing member to bias the slip to the disengaged position.

26. An elevator configured to grip and lift a rigid shoulderless pipe segment having a substantially circular cross-section, the elevator comprising:

a U-shaped body having a proximal end configured to receive an outer surface of the rigid shoulderless pipe segment and a distal end comprising at least one jaw retractable into and extendable from the U-shaped body;

a first pipe contact member positioned in the proximal end of the U-shaped body; and a second pipe contact member positioned upon the at least one jaw, the first and second pipe contact members configured to engage the rigid shoulderless pipe segment when the at least one jaw is extended from the U-shaped body;

wherein the first and the second pipe contact members are configured to transfer substantially all of the lifting loads from the U-shaped body to the outer surface of the rigid shoulderless pipe segment when engaged with the rigid shoulderless pipe segment.

27. The elevator of claim 26, wherein at least one of the first pipe contact member and the second pipe contact member comprises a plurality of pipe contact members.

28. The elevator of claim 26, wherein at least one of the first pipe contact member and the second pipe contact member comprises at least one set of slips.

29. The elevator of claim 26, wherein the first and second pipe contact members are configured to release the rigid shoulderless pipe segment from the U-shaped body when the at least one jaw is retracted into the U-shaped body.

30. The elevator of claim 26, wherein the U-shaped body is configured to engage a first rigid shoulderless pipe segment positioned adjacent to a second rigid shoulderless pipe segment when the at least one jaw is retracted into the U-shaped body.

31. The elevator of claim 30, wherein the elevator is configured to lift the first rigid shoulderless pipe segment away from the second rigid shoulderless pipe segment when the at least one jaw is extended from the U-shaped body.

32. The elevator of claim 26, wherein the at least one jaw is retractable into and extendable from at least one leg extension of the distal end of the U-shaped body.

33. An elevator configured to grip and lift a rigid shoulderless pipe segment having a substantially circular cross-section, the elevator comprising:

a U-shaped body having a proximal end configured to receive an outer surface of the rigid shoulderless pipe segment and a distal end comprising at least one jaw retractable into and extendable from the U-shaped body; and a plurality of pipe contact members coupled to the U-shaped body;

wherein the plurality of contact members are configured to engage the rigid shoulderless pipe segment when the at least one jaw is extended from the U-shaped body; and wherein the plurality of pipe contact members are configured to transfer substantially all of the lifting loads from the U-shaped body to the outer surface of the rigid shoulderless pipe segment when engaged with the rigid shoulderless pipe segment.

34. The elevator of claim 33, wherein the plurality of pipe contact members comprises at least a first pipe contact member and a second pipe contact member.

35. The elevator of claim 34, wherein the first pipe contact member of the plurality of contact members is positioned in the proximal end of the U-shaped body, and wherein the second pipe contact member of the plurality of contact members is positioned upon the at least one jaw.

36. The elevator of claim 35, wherein the plurality of pipe contact members comprises a third pipe contact member and a fourth pipe contact member.

37. The elevator of claim 36, wherein the third pipe contact member of the plurality of contact members is positioned in the proximal end of the U-shaped body, and wherein the second pipe contact member of the plurality of contact members is positioned upon at least another jaw retractable into and extendable from the U-shaped body.

38. The elevator of claim 33, wherein at least one of the plurality of pipe contact members comprises at least one set of slips.

39. The elevator of claim 33, wherein the plurality of pipe contact members are configured to release the rigid shoulderless pipe segment from the U-shaped body when the at least one jaw is retracted into the U-shaped body.

* * * * *